United States Patent [19]

Masuda et al.

[11] 4,078,936

[45] Mar. 14, 1978

[54] SILVER HALIDE EMULSION CONTAINING TWO-EQUIVALENT YELLOW COUPLER

[75] Inventors: Kosaku Masuda; Mamoru Nakatani; Kiyoshi Yamashita; Yasushi Usagawa; Satoshi Kawakatsu, all of Nagaokakyo, Japan

[73] Assignee: Mitsubishi Paper Mills, Ltd., Tokyo, Japan

[21] Appl. No.: 685,672

[22] Filed: May 12, 1976

[30] Foreign Application Priority Data

May 28, 1975 Japan ..... 50-63808

[51] Int. Cl.[2] ..... G03C 1/40

[52] U.S. Cl. ..... 96/100 R; 96/56.2; 96/56.3; 96/56.4; 260/289 K; 260/332.3 P; 260/343.45; 260/343.43

[58] Field of Search ..... 96/100, 56.2, 56.3, 96/56.4

[56] References Cited

U.S. PATENT DOCUMENTS 3,644,498 2/1972 Loria ..... 96/100

3,839,044 10/1974 Salminen et al. ..... 96/100

*Primary Examiner*—J. Travis Brown

*Attorney, Agent, or Firm*—Cushman, Darby & Cushman

[57] ABSTRACT

The two-equivalent yellow coupler having the following formula has an extremely high reactivity, produces an image of high density in color development and causes little fogging and no ground coloration:

wherein Coupl, $R_1$ - $R_5$ and A are as defined hereinafter.

10 Claims, No Drawings

SILVER HALIDE EMULSION CONTAINING TWO-EQUIVALENT YELLOW COUPLER

This invention relates to novel two-equivalent yellow couplers for use in color photography and their use in color photography.

In color photography, azomethine dyes are generally employed for the yellow dye image. Compounds having open-chain active methylene groups are used as the coupler which forms an azomethine dye on color development by coupling with the oxidized product of a color developing agent.

The coupler for use in color photography must be colorless as such and should neither cause fogging nor have adverse effects on sensitivity or other photographic characteristics of the silver halide emulsion. It should not participate in those reactions with other ingredients in the emulsion which cause adverse effects. In color development, the coupler is required to be of good coupling reactivity, causing neither fogging nor staining of the unexposed portion; the dye formed on development must be fast to light and wet heat; and the coupler remaining after development should not cause discoloration or staining on exposure to light and wet heat.

In recent years, by the use of a bleach-fix bath, the photographic treatment steps have been greatly simplified, resulting in a marked reduction in the time required for the treatment. It is difficult, however, to obtain a required density with most of the so-called four-equivalent couplers, in which the open-chain active methylene groups remain unsubstituted by other groups. Accordingly, it has been desired to improve the coupler with respect to such a disadvantage. There has already been known a coupler in which one of the hydrogens of the active methylene group in a four-equivalent coupler had been substituted by a substituent which will be split off by coupling reaction on development. This type of coupler is called two-equivalent coupler, since it requires two moles of silver halide to form one mole of the dye.

The coupler of the two-equivalent type has the following advantages over the four-equivalent type.

1. Because of a sufficiently high coupling reactivity, there is required in development neither a long time nor such a condition as an excessively high pH or a high temperature.
2. A satisfactory density may be obtained by use of a bleach-fix bath, because the coupling reaction does not terminate in the colorless leuco stage of the dye.
3. Only half as much silver halide is required to produce a given amount of the dye, resulting in cost reduction.
4. The resolving power and sharpness of the color image may be improved, because of possible reduction in the thickness of emulsion layer.
5. The sensitivity of the multilayer emulsion coating is improved because of better light transmission to lower layers.

These advantages originate in the high coupling reactivity of the coupler, which is in favor of the rapid processing. Although depending on the type of splittable group, there are couplers which tend to cause fogging and other stainings, or are subject to undesirable side reactions in color development, or even of not so high a coupling reactivity. Conventional couplers, in general, fail to meet one or more of the aforesaid requirements.

An object of the present invention is to provide a yellow coupler which has an extremely high reactivity, produces an image of high density in color development, and causes little fogging and no ground coloration when exposed to light or wet heat.

The present yellow coupler is represented by the following general formula:

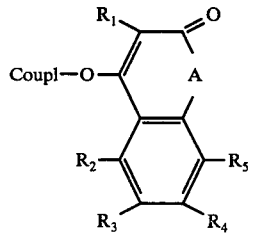

wherein Coupl represents a residue of an yellow coupler having an active methine group. A represents O, S, NH or NR [R represents (1) an alkyl group of 1–3 carbon atoms exemplified by methyl, ethyl and isopropyl; (2) aryl group such as phenyl group inclusive of halo-, alkoxy-, or alkyl-substituted aryl groups; or (3) an alkenyl group such as allyl groups], $R_1$, $R_2$, $R_3$, $R_4$ and $R_5$ represent (1) hydrogen; (2) halogen atoms; (3) an alkyl group of 1–4 carbon atoms exemplified by methyl, ethyl and tert. butyl; (4) an aryl group; (5) an alkoxy group of 1–4 carbon atoms exemplified by methoxy, ethoxy, isopropoxy and butoxy groups; (6) an acyl group exemplified by acetyl, propionyl and benzoyl; (7) amino group; (8) an aralkyl group; (9) an aralkyloxy group; (10) an aryloxy group such as phenoxy group; (11) a carboxy group of 1–10 carbon atoms exemplified by carboxy, methoxy carbonyl, ethoxy carbonyl, phenoxycarbonyl and naphthoxycarbonyl; (12) an acyloxy group of the formula, $$R_6—CO—O$$

wherein $R_6$ is an alkyl group of 1–20 carbon atoms or an aryl group such as a phenyl or a naphthyl group inclusive of halo-, alkoxy, or alkyl-substituted aryl groups; (13) a carbamoyl group; (14) a sulfonamide group; or (15) an acylamino group, and $R_2$ and $R_3$, or $R_3$ and $R_4$, or $R_4$ and $R_5$ may jointly form a ring.

Of the couplers represented by the above formula, those in which A is O are more effective because color density is excellent. $R_1$ is preferably hydrogen. In preparation of the present coupler by reacting a yellow coupler formed by substituting one of hydrogen atoms of active methylene group of a four-equivalent coupler by an halogen atom with a hydroxycoumarin, a hydroxythiacoumarin, or a hydroxycarbostyril, yield is lowered and purification becomes difficult when $R_1$ is substituted with substituents other than hydrogen. $R_2$, $R_3$, $R_4$ and $R_5$ are more preferably hydrogen or electron attractive group than electron donative group when color density is taken into consideration.

That is, $R_2$, $R_3$, $R_4$ and $R_5$ are preferably hydrogen, halogen atoms, acyl group, acyloxy group, carboxyl group or sulfonamide group among which hydrogen, halogen atoms and acyloxy group are especially preferred. Furthermore, from the point of synthesis, $R_3$ or $R_4$ is preferably hydrogen, halogen atom or acyloxy group.

The coupler represented by the above formula does not modify the characteristics of silver halide emulsion and the dye formed therefrom is stable to light and wet heat and has desirable absorption characteristics. Such a coupler of excellent characteristics is characterized by being of a structure of a four-equivalent coupler having one of the hydrogen atoms of its active methylene group substituted by a hydroxycoumarin ring, a hydroxythiacoumarin ring, a hydroxycarbostyril ring, etc. The typical substituents include the following groups:

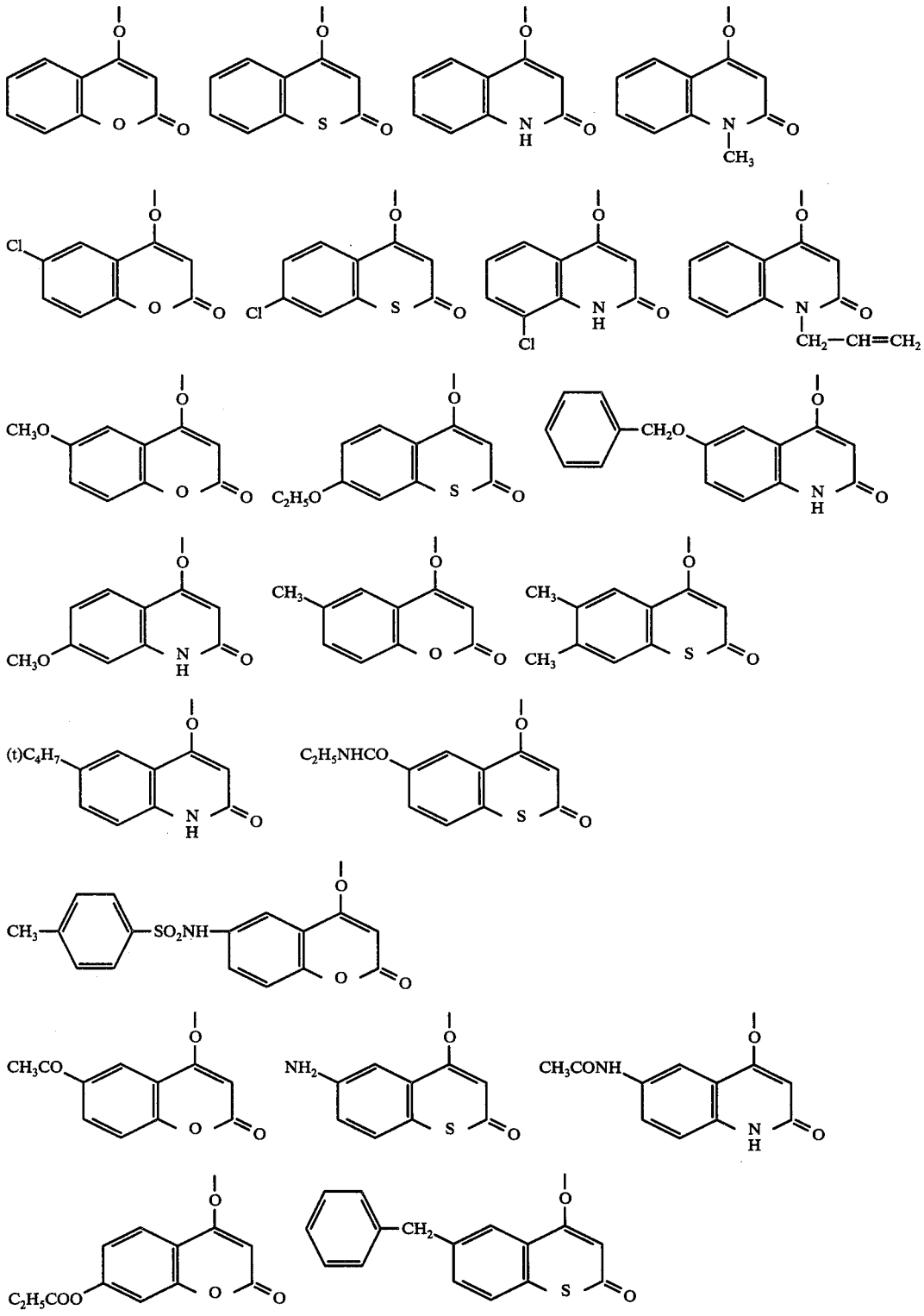

-continued
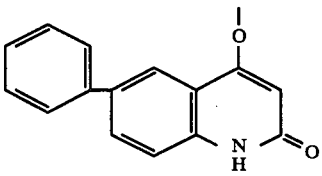
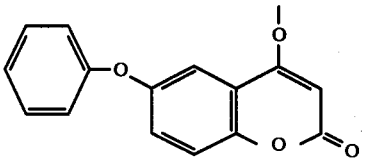
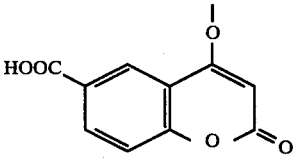
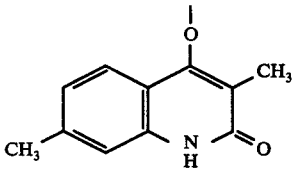
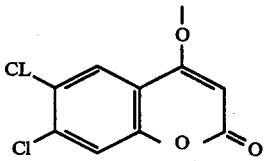
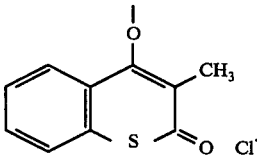
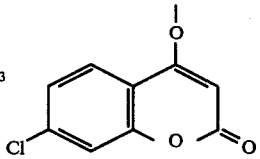
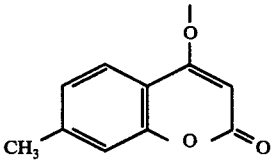
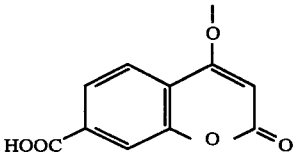
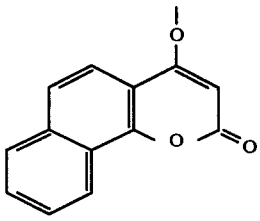
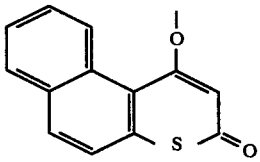
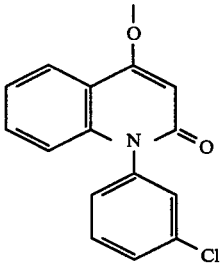
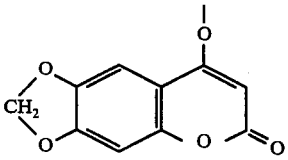
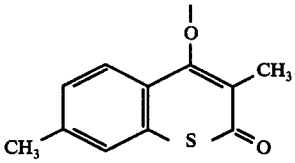
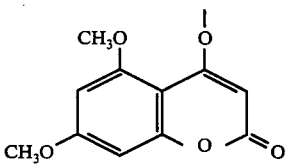
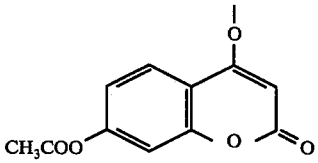
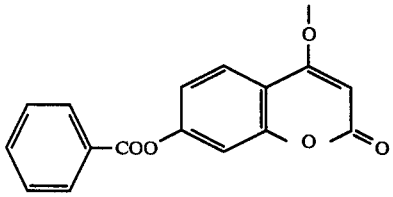
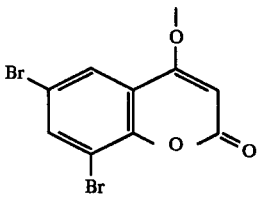
Typical examples of individual couplers of this invention are given below.
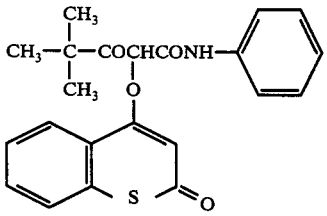
(1)

-continued
(2)
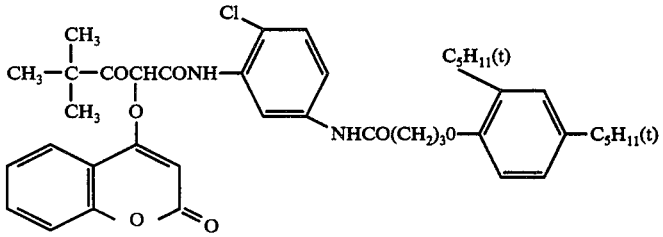
(3)
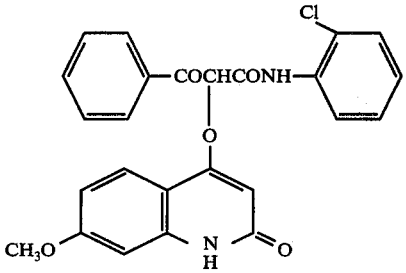
(4)
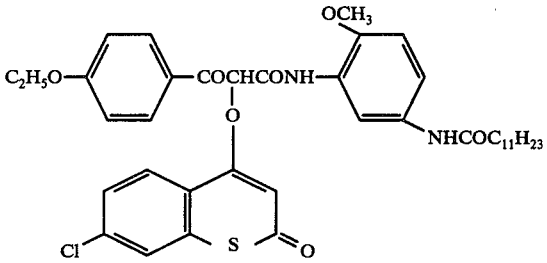
(5)
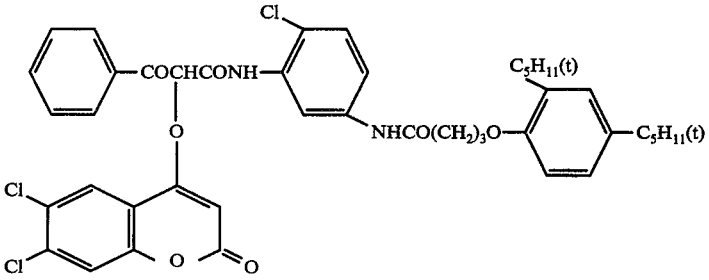
(6)
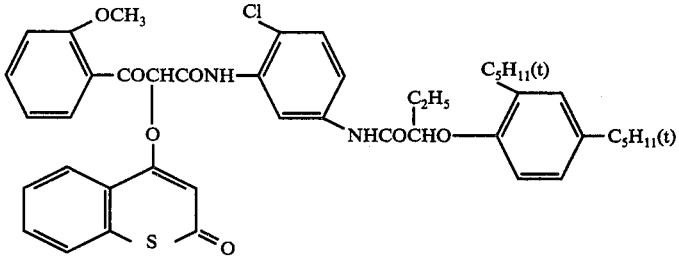
(7)
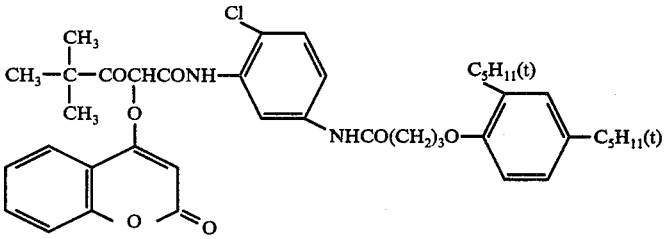
(8)
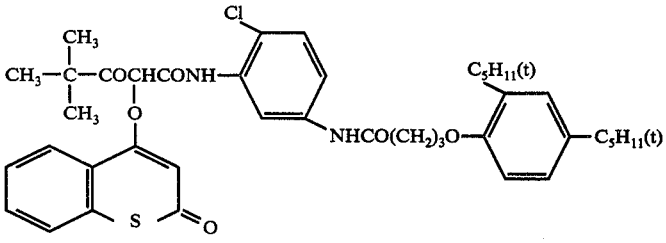

-continued
(9)
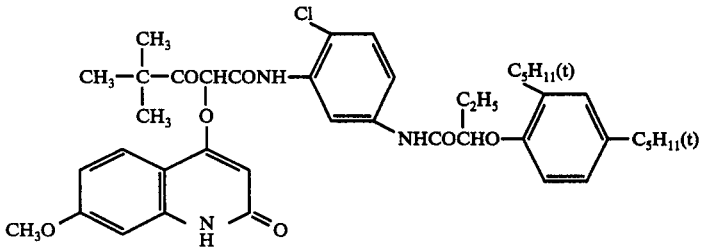
(10)
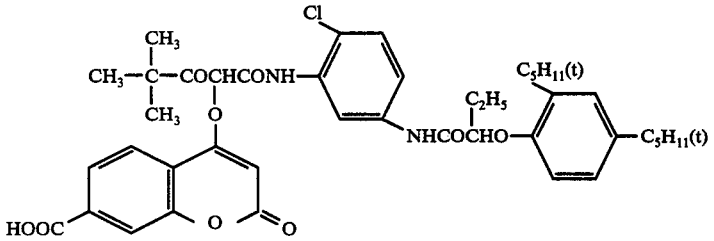
(11)
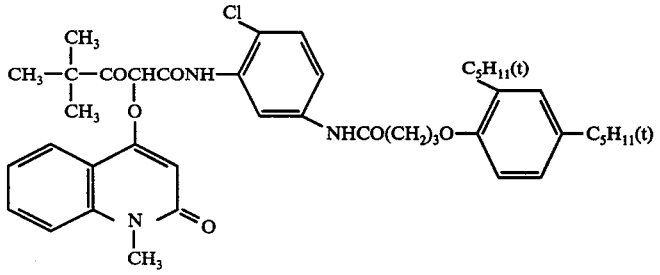
(12)
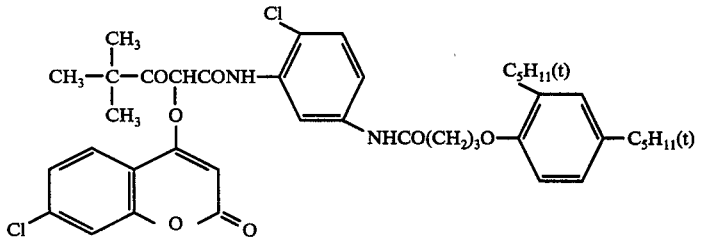
(13)
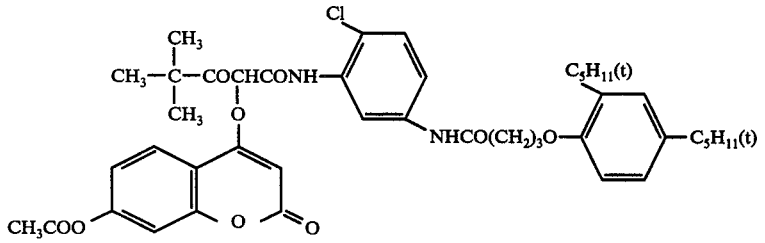
(14)
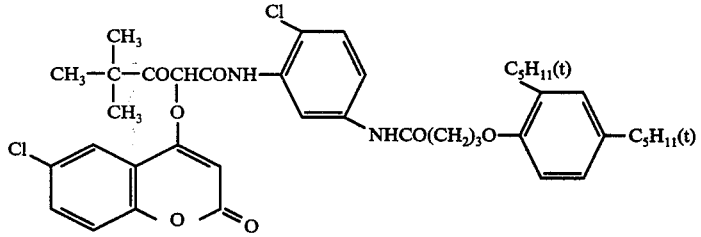
(15)
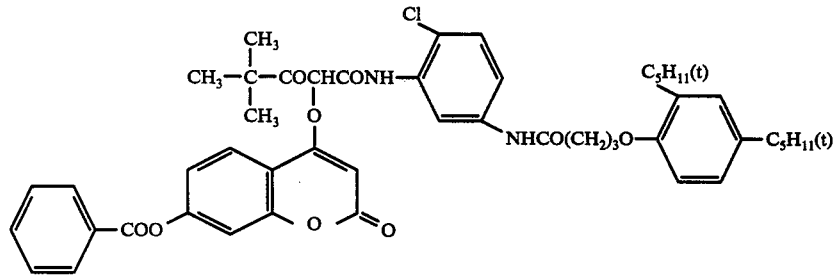

-continued (16)

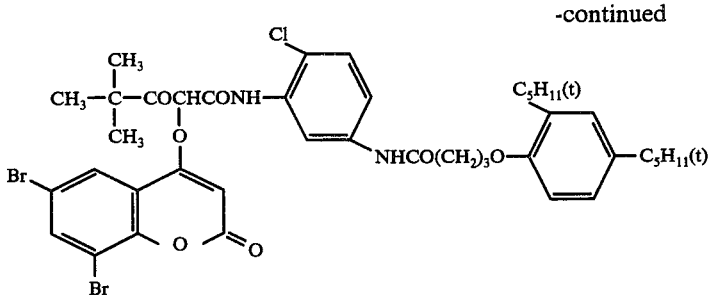

The coupler of this invention may be synthesized by reacting a yellow coupler of the four-equivalent type having one of the hydrogen atoms of its active methylene group substituted by a halogen atom with a hydroxycoumarin, hydroxythiacoumarin, or hydroxycarbostyril compound.

The procedure for synthesizing a typical coupler of the present invention is illustrated below with reference to examples.

SYNTHETICAL EXAMPLE 1

The coupler (2) of the typical examples

In 100 ml of acetonitrile, 12 g of α-chloro-α-pivaloyl-2-chloro-5-[γ-(2,4-di-tert-pentylphenoxy)butyramido]-acetanilide, 3.8 g of 4-hydroxycoumarin, and 5 ml of triethylamine were heated under reflux for 3 hours to allow the reaction to proceed. The reaction mixture was evaporated under reduced pressure to dryness and the residue was recrystallized from acetonitrile to obtain 9 g of colorless crystals in needle form melting at 118°–120° C.

| Elementary analysis: $C_{42}H_{51}N_2O_7Cl \cdot H_2O$ | C | H | N |
|---|---|---|---|
| Calculated, % | 67.32 | 7.13 | 3.74 |
| Found, % | 67.32 | 7.33 | 3.64 |

SYNTHETICAL EXAMPLE 2

The coupler (7) of the typical examples

In 100 ml of acetonitrile, 12 g of α-chloro-α-pivaloyl-2-chloro-5-[γ-(2,4-di-tert-pentylphenoxy)butyramido]-acetanilide, 4 g of 4-hydroxy-7-methylcoumarin, and 5 ml of triethylamine were heated under reflux for 3 hours to allow the reaction to proceed. The reaction mixture was evaporated under reduced pressure to dryness and the residue was recrystallized from acetonitrile to obtain 12 g of colorless crystals in needle form having a melting point of 158°–160° C.

| Elementary analysis: $C_{43}H_{53}N_2O_7Cl \cdot H_2O$ | C | H | N |
|---|---|---|---|
| Calculated, % | 67.65 | 7.26 | 3.67 |
| Found, % | 67.52 | 7.06 | 3.88 |

Other couplers of this invention may be synthesized in a manner similar to that described above.

The amount of the present coupler used varies depending on the kind of light sensitive material in which it is used and the type of developing treatment. In the case of using as non-diffusible coupler, the range of 0.01–3 (molar ratio to silver halide in emulsion) is effective and especially 0.1–2 is preferred. When less than the lower limit, a large amount of silver halide is required for providing such color density as demanded for light sensitive materials and hence the thickness of emulsion layer is increased to cause reduction in sharpness of image and moreover to make it difficult to conduct a rapid developing treatment. When more than the upper limit, conversion of the coupler into dye is insufficient and utility efficiency of the coupler is low. This is economically disadvantageous. Furthermore, thickness of the emulsion layer is also increased to cause said defects. Thus, when the amount of the coupler used is outside said range, the advantages to be obtained by the present invention cannot be sufficiently accomplished.

The present coupler may be applied to color photographic processes in conventional ways. It can be incorporated as the diffusible coupler in the developer which supplies the coupler to the emulsion layer during developing treatment. Alternatively, it can be incorporated as the non-diffusible coupler in the emulsion layer by dissolving the coupler in a mixture of a high-boiling solvent such as dibutyl phthalate and an auxiliary solvent such as ethyl acetate, dispersing the resulting solution in an aqueous solution containing a hydrophilic polymer such as gelatin and a surface active agent, adding the resulting dispersion to a sensitive silver halide emulsion, and coating the resulting emulsion on a support material such as film base, baryta paper, or laminated paper. The silver halide emulsion may contain various additives customarily used in silver halide color photographic materials, such as sensitizers, stabilizers, hardners, UV absorbers, etc.

Examples are given below for the purpose of illustrating that the present coupler is excellent in chromogenic efficiency without adverse effects on other photographic characteristics of the color photographic material.

EXAMPLE 1

An emulsion prepared so that the molar ratio of silver halide to coupler (shown in Table 1) may become 2 to 1 was coated on an undercoated polyester film and dried to obtain a light sensitive material. The coating amount was regulated so that $3.3 \times 10^{-3}$ mole/m$^2$ of the coupler was coated. The solvent used was dibutyl phthalate and the auxiliary solvent was ethyl acetate. After exposure the light sensitive material was developed for 6 minutes by use of a developing solution of the following composition:

| | |
|---|---|
| Sodium hydroxide | 1.65 g |
| Sodium metaborate | 50 g |
| Anhydrous sodium sulfite | 1.8 g |
| Potassium bromide | 0.5 g |
| 4-Amino-N-ethyl-N-(β-methanesulfonamidoethyl)-m-toluidine sesquisulfate monohydrate | 4.4 g |
| Sodium hexametaphosphate | 0.5 g |

-continued

| | |
|---|---|
| Hydroxylamine hydrochloride | 1.0 g |
| Benzyl alcohol | 24 ml |
| Diethylene glycol | 10 ml |
| Made up with water to | 1 liter |

After development the material was bleached and fixed in an iron ethylenediaminetetraacetate bleach-fix bath for 4 minutes.

| | |
|---|---|
| Iron ethylenediaminetetraacetate | 56 g |
| Disodium ethylenediamine-tetraacetate | 2 g |
| Ammonium thiosulfate | 60 g |
| Anhydrous sodium sulfite | 20 g |
| Disodium phosphate | 12 g |
| Sodium hydrogensulfite | 5 g |
| Made up with water to | 1 liter |

Thereafter the material was washed with water for 8 minutes, immersed in a stabilizing bath for 3 minutes, and dried. The spectral absorption of the yellow image thus obtained was measured by means of a spectro-photometer (UV-200 of Shimadzu Seisakusho Ltd.) and the results obtained were as shown in Table 1.

For comparison, the following known four-equivalent couplers corresponding to the present couplers were used: α-benzoyl-2-chloro-5-[γ-(2,4-di-tert-pentylphenoxy)butyramido]acetanilide (comparative coupler A), α-(2-methoxybenzoyl)-2-chloro-5-[α-(2,4-di-tert-pentylphenoxy)butyramido]acetanilide (comparative coupler B), and α-pivaloyl-2-chloro-5-[γ-2,4-di-tert-pentylphenoxy)butyramido]acetanilide (comparative coupler C).

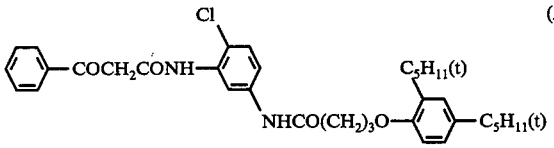

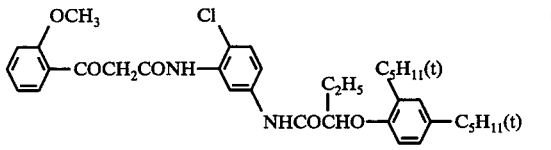

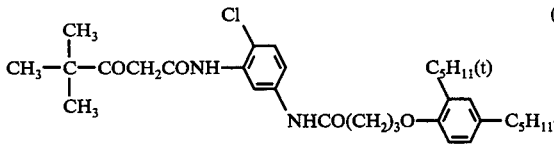

Table 1

| Coupler | (5) | (A)* | (6) | (B)* | (11) | (C)* |
|---|---|---|---|---|---|---|
| Wave length at absorption maximum, nm | 446 | 446 | 435 | 434 | 438 | 439 |

Note:
*Comparative coupler

As is apparent from Table 1, the yellow dye images formed from the present couplers (5), (6) and (11) are approximately the same in wavelength of maximum absorption and distribution of spectral absorption as those from the four-equivalent couplers having the same structures as those of the present couplers, except for the splittable substituents each attached to the carbon atom of the active methylene group by substitution. This proves that substitution of a hydroxycoumarin ring, hydroxythiacoumarin ring, or hydroxycarbostyril ring for one of the hydrogen atoms in four-equivalent coupler has none of those adverse effects on the distribution of spectral absorption which have been encountered with conventional two-equivalent couplers.

EXAMPLE 2

The light sensitive materials prepared in the same manner as in Example 1 with use of the couplers shown in Table 2 were developed, without preceding exposure, with the same developing solution as shown in Example 1 for 12 minutes, and bleached, fixed, washed with water, and stabilized in the same manner as in Example 1. The light sensitive materials were treated for the fog density.

For comparison, there were used comparative couplers (A), (B) and (C), which were the same as used in Example 1, and the following known two-equivalents couplers: α-benzoyl-α-chloro-2-chloro-5-[γ-(2,4-di-tert-pentylphenoxy)butyramido]acetanilide (comparative coupler D), α-(2-methoxybenzoyl)-α-chloro-2-chloro-5-[α-(2,4-di-tert-pentylphenoxy)butyramido]acetanilide (comparative coupler E), or α-pivaloyl-α-chloro-2-chloro-5-[γ-(2,4-di-tert-pentylphenoxy)butyramido]-acetanilide (comparative coupler F).

Determination of the fog density was conducted by means of a transmission densitometer (TD-504 of Macbeth Co.)

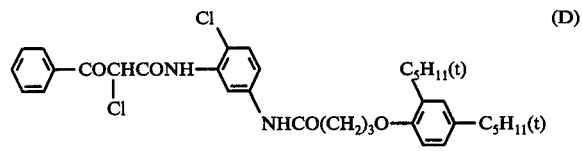

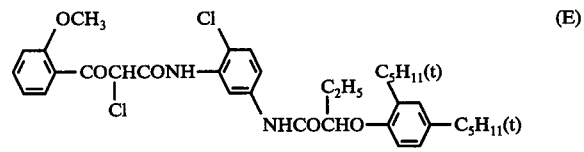

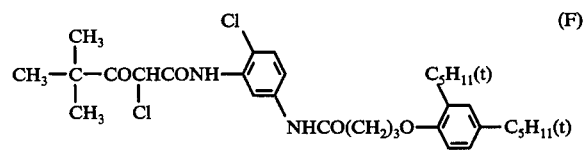

Table 2

| | Present couplers | Known four-equivalent coupler | Known two-equivalent coupler |
|---|---|---|---|
| Coupler | (5) | (A) | (D) |
| Fog | 0.07 | 0.07 | 0.40 |
| Coupler | (6) | (B) | (E) |
| Fog | 0.07 | 0.06 | 0.20 |
| Coupler | (12) | (C) | (F) |
| Fog | 0.06 | 0.06 | 0.09 |
| Coupler | (13) | | |
| Fog | 0.05 | | |
| Coupler | (15) | | |
| Fog | 0.06 | | |
| Coupler | (16) | | |
| Fog | 0.07 | | |

As is apparent from Table 2, the present couplers do not increase the fog density, contrary to the conventional two-equivalent couplers. With respect to fogging, the present couplers are comparable to four-equivalent couplers, indicating that the splittable substituents according to this invention are superior to those used in conventional two-equivalents couplers in the property not to increase fogging.

EXAMPLE 3

A light sensitive material prepared as in Example 1 with use of the present couplers shown in Table 3 was subjected, without preceding exposure, successively to color development, bleaching and fixing, washing with water, and stabilization. The coloration staining of the thus treated material was determined after exposure to sunlight for 4 weeks or after storage at 50° C and a relative humidity of 80% for one month. The results obtained were as shown in Table 3. The degree of coloration staining was evaluated by density measurement in the same manner as in Example 2. A known four-equivalent coupler (comparative coupler C) was used for comparison.

Table 3

| Coupler | (5) | (6) | (7) | C* |
|---|---|---|---|---|
| Density increase after exposure to sunlight | 0.02 | 0.01 | 0.02 | 0.02 |
| Density increase after storage at 50° C, and 80% R.H. | 0.01 | 0.01 | 0.01 | 0.01 |

Note:
*Comparative coupler C

As is apparent from Table 3, the present couplers (5), (6) and (7) scarcely produce coloration on exposure to light and wet heat and is comparable in this respect to the comparative coupler C which is widely known for its stability to light and wet heat, having substantially no tendency of color staining. The above results indicate that the present two-equivalent couplers are free from the coloration defect common to conventional two-equivalent couplers.

EXAMPLE 4

A light sensitive material prepared as in Example 1 with use of the present coupler (8) was exposed through an optical wedge. In the same manner as in Example 1, the exposed light sensitive material was color-developed, bleached and fixed, washed with water, and stabilized. A portion of the material thus treated was exposed to the sunlight for four weeks and the decrease in density of the color image was determined, the initial density having been 1.0. Another portion of the material was stored at 50° C and 80% R.H. for one month and the decrease in density of the color image was also determined, the initial density having been 1.0. The results obtained were as shown in Table 4. The aforesaid conventional couplers C and F were used for comparison.

Table 4

| Coupler | Present coupler (8) | Known 4-equiv. coupler (C) | Known 2-equiv. coupler (F) |
|---|---|---|---|
| Density decrease after exposure to sunlight | 0.30 | 0.37 | 0.41 |
| Density decrease after storage at 50° C and 80% R.H. | 0.04 | 0.10 | 0.07 |

Table 4 shows that the yellow color image produced by use of the present coupler is superior in fastness to light and wet heat to those obtained from the comparative couplers, indicating that the splittable group of the present coupler contributed to the improvement in fastness to light and wet heat, contrary to the conventional two-equivalent coupler.

EXAMPLE 5

A light sensitive material prepared as in Example 1 with use of the present couplers shown in Table 5 was exposed through an optical wedge. In the same manner as in Example 1, the exposed light sensitive material was developed, bleached and fixed, washed with water, and stabilized. The density of the yellow color image was measured and obtained the maximum density as shown in Table 5. For comparison, there were used among known four-equivalent couplers the comparative C used in Example 1 and among known two-equivalent couplers the comparative coupler F and α-pivaloyl-α-(4-carbomethoxyphenoxy)-2-chloro-5-[γ-(2,4-di-tert-pentylphenoxy)butyramido]acetanilide (comparative coupler G) and α-pivaloyl-α-succinimido-2-chloro-5-[γ-(2,4-di-tert-pentylphenoxy)butyramido]acetanilide (comparative coupler H).

(G)

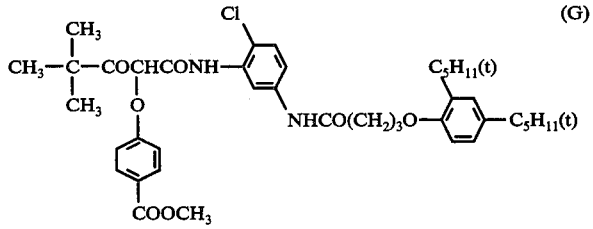

(H)

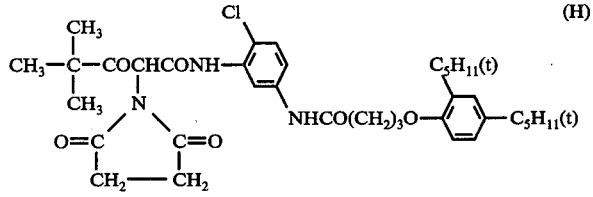

Table 5

| | Couplers | Maximum density |
|---|---|---|
| The present couplers | (2) | 2.30 |
| | (7) | 2.25 |
| | (8) | 2.18 |
| | (11) | 2.07 |
| | (13) | 2.35 |
| | (15) | 2.37 |
| | (16) | 2.30 |
| Comparative two-equivalent couplers | (F) | 1.58 |
| | (G) | 1.88 |
| | (H) | 1.95 |
| Comparative four-equivalent couplers | (C) | 0.85 |

As is apparent from Table 5, as compared with known four-equivalent or two-equivalent couplers, the present couplers greatly improve the maximum density, indicating an excellent color forming efficiency of the present coupler.

What is claimed is:

1. A light sensitive silver halide emulsion containing a two-equivalent yellow coupler which is represented by the following general formula:

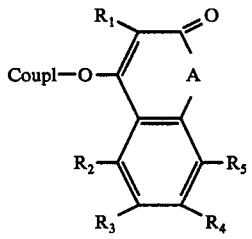

wherein Coupl represents a residue of a yellow coupler having an active methine group, A represents O, S, NH or NR in which R represents an alkyl group of 1–3 carbon atoms, aryl group or an alkenyl group, $R_1$, $R_2$, $R_3$, $R_4$ and $R_5$ represent hydrogen, halogen atoms, an alkyl group of 1–4 carbon atoms, an aryl group, an alkoxy group of 1–4 carbon atoms, an acyl group, amino group, an aralkyl group, an aralkyloxy group, an aryloxy group, a carboxy group of 1–10 carbon atoms, an acyloxy group of the formula $R_6$—CO—O (wherein $R_6$ is an alkyl group of 1–20 carbon atoms or an aryl group), a carbamoyl group, a sulfonamido group, or an acylamino group, and $R_2$ and $R_3$, or $R_3$ and $R_4$, or $R_4$ and $R_5$ may jointly form a ring.

2. A light sensitive silver halide emulsion according to claim 1 wherein the yellow coupler is selected from the group consisting of (1)

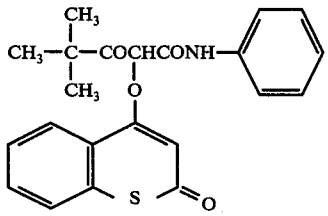

(2)

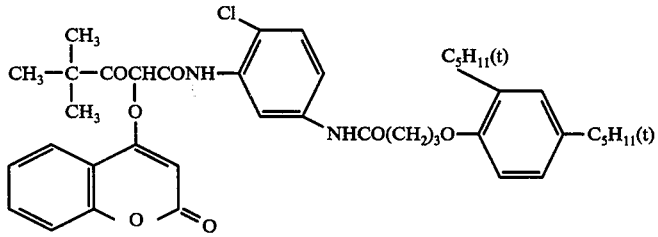

(3)

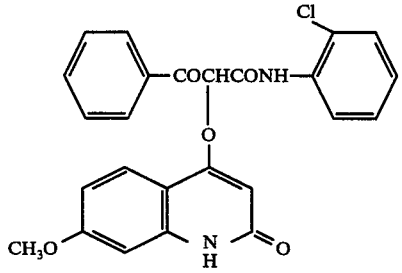

(4)

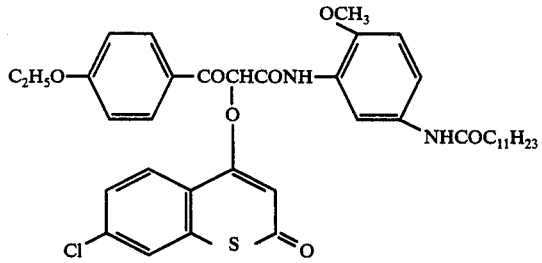

(5)

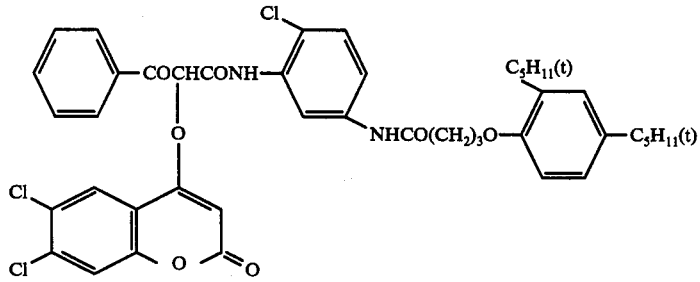

-continued
(6)
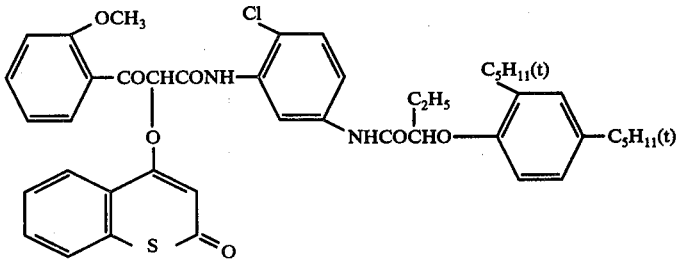
(7)
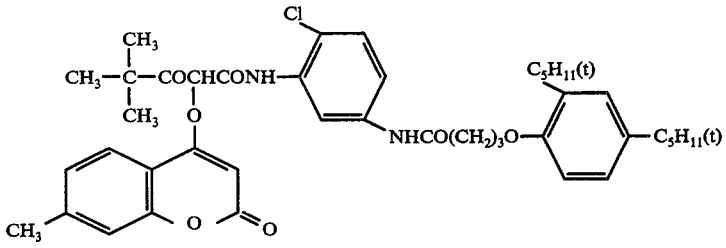
(8)
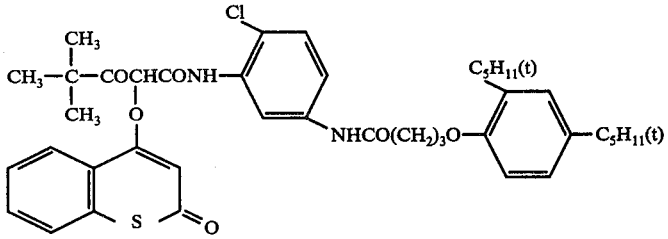
(9)
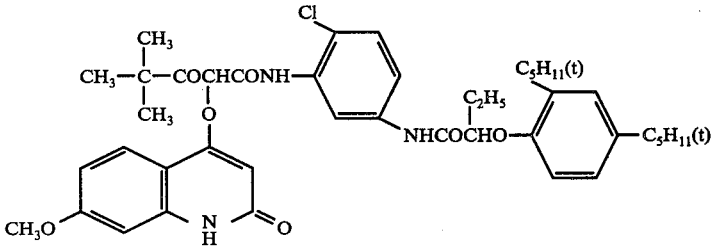
(10)
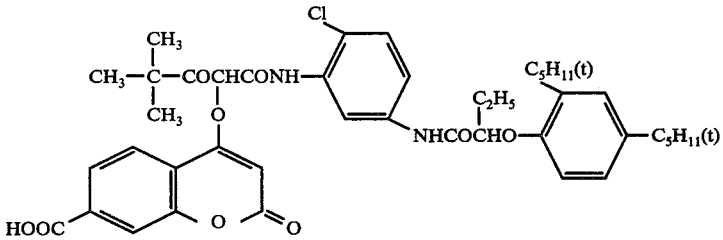
(11)
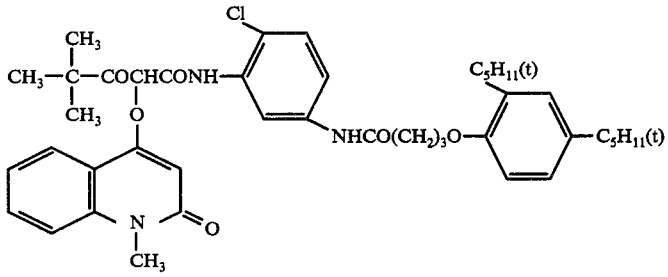
(12)
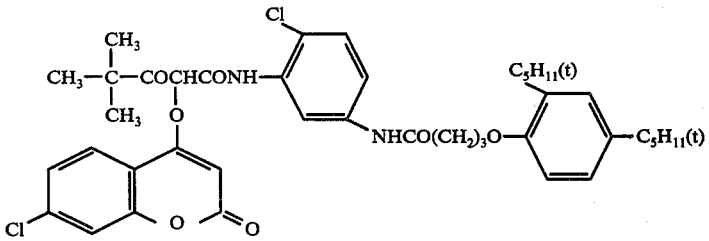

-continued (13)

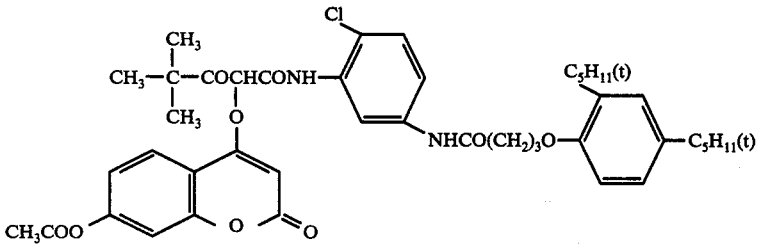

(14)

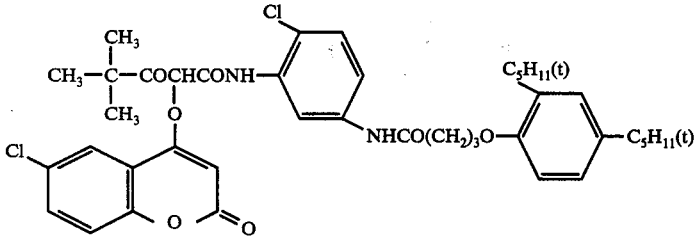

(15)

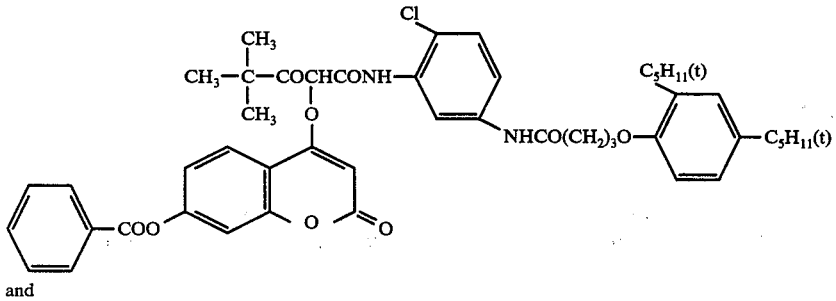

and (16)

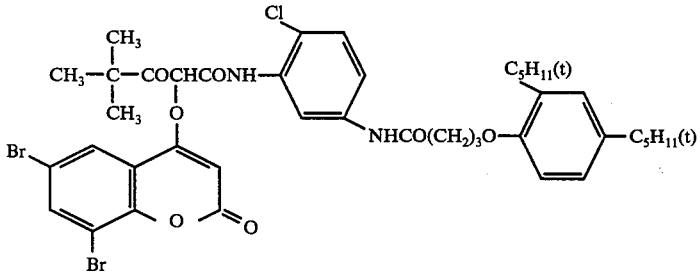

3. A light sensitive silver halide emulsion according to claim 1, wherein $R_1$ in the general formula is hydrogen.

4. A light sensitive silver halide emulsion according to claim 3, wherein A in the general formula is oxygen.

5. A light sensitive silver halide emulsion according to claim 1 containing a two-equivalent yellow coupler having the formula:

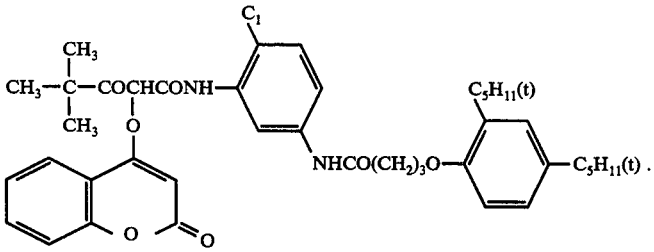

6. A light sensitive silver halide emulsion according to claim 1 containing a two-equivalent yellow coupler having the formula:

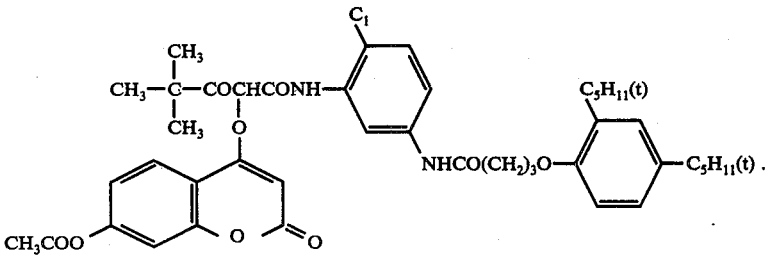

7. A light sensitive silver halide emulsion according to claim 1 containing a formula:

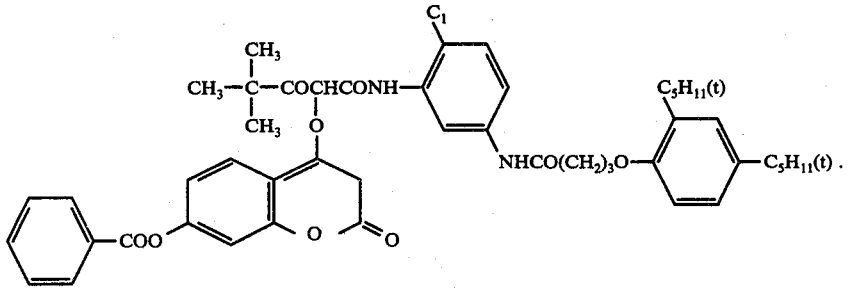

8. A light sensitive silver halide emulsion according to claim 1 containing a two-equivalent yellow coupler having the formula:

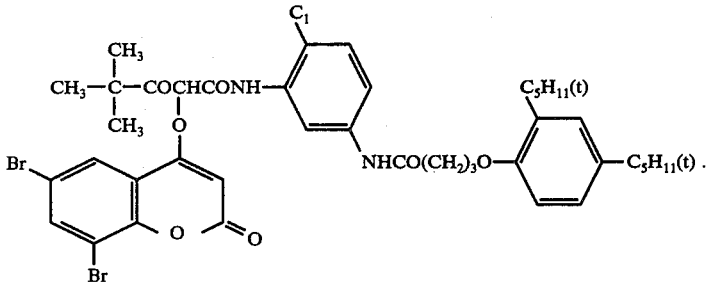

9. Lightsensitive silver halide emulsion according to claim 1, wherein the molar ratio of the coupler to the silver halide is 1 : 0.01 – 1 : 3.

10. Color photographic material containing the yellow coupler according to claim 1 in a silver halide emulsion layer.

* * * * *